United States Patent [19]

Hipp et al.

[11] Patent Number: 4,822,235

[45] Date of Patent: Apr. 18, 1989

[54] DEVICE FOR BREAKING AND STRIPPING COINS FROM A COIN ROLL

[76] Inventors: David R. Hipp, Box 398B, R.D. #1, Coatesville, Pa. 19320; Carl D. Hipp, 1632 Pulaski Dr., West Chester, Pa. 19382

[21] Appl. No.: 18,374

[22] Filed: Feb. 24, 1987

[51] Int. Cl.[4] ..... B65G 65/30

[52] U.S. Cl. ..... 414/4 11; 225/103; 294/116; 414/417; 453/63

[58] Field of Search ..... 414/411, 412, 417; 225/93, 103, 96.5; 453/63; 222/87; 294/116

[56] References Cited

U.S. PATENT DOCUMENTS

| | | | |
|---|---|---|---|
| 1,315,799 | 9/1919 | Suman | 225/96.5 |
| 2,362,115 | 11/1944 | Cline | 225/96.5 |
| 2,638,022 | 5/1953 | Reyes | 225/96.5 X |
| 2,659,253 | 11/1953 | Myrick | 225/93 |
| 2,700,972 | 2/1955 | Haden | 225/93 X |
| 2,869,413 | 1/1959 | Anderson | 30/94 X |
| 2,878,619 | 3/1959 | Van Steyn | 225/96.5 |
| 3,160,339 | 12/1964 | Love | 225/96.5 |
| 3,380,636 | 4/1968 | Ushkow | 225/96.5 X |
| 3,487,965 | 1/1970 | Gale | 414/412 X |
| 3,515,326 | 6/1970 | Saito et al. | 225/96.5 |
| 3,640,437 | 2/1972 | Galy | 225/103 X |
| 3,651,751 | 3/1972 | Randrup | 414/411 X |
| 3,659,764 | 5/1972 | Janiszewski | 225/96.5 X |
| 3,692,220 | 9/1972 | Seng | 225/96.5 |
| 3,720,435 | 3/1973 | Leyn | 274/116 X |
| 3,722,055 | 3/1973 | D'Ercole et al. | 225/93 X |
| 3,739,966 | 6/1973 | Lynn | 225/96.5 |
| 3,781,987 | 1/1974 | Gentscheff | 30/2 |
| 4,038,746 | 8/1977 | Bromley | 453/63 X |
| 4,040,183 | 8/1977 | Cassier | 30/296 R |
| 4,299,532 | 11/1981 | Bouwmeester | 294/116 X |
| 4,333,234 | 6/1982 | Smith et al. | 30/2 |
| 4,382,330 | 5/1983 | Harbaugh | 30/124 |
| 4,428,709 | 1/1984 | Peters | 414/412 |
| 4,473,192 | 9/1984 | Urban et al. | 225/103 X |
| 4,504,003 | 3/1985 | Moody | 225/96.5 |
| 4,516,712 | 5/1985 | Whalley | 225/96.5 |

FOREIGN PATENT DOCUMENTS

| | | | |
|---|---|---|---|
| 79893 | 6/1983 | European Pat. Off. | 222/87 |

*Primary Examiner*—David A. Bucci

*Attorney, Agent, or Firm*—Panitch Schwarze Jacobs & Nadel

[57] ABSTRACT

An apparatus for breaking and stripping coins from a coin roll includes a pair of elements each having a channel adapted for receiving a portion of the coin roll and support members supporting the pair of elements in a first orientation adjoining one another with channels aligned for simultaneously receiving an elongated roll of wrapped coins. The support members further permit translational movement of the elements relative to one another to a second orientation with channels transversely displaced to break the coin roll simultaneously received in the pair of channels. Each of the elements is provided with a pair of reciprocable arms for gripping the portion of the roll in the channel. Stripper members are passed through the channel and arms of each of the elements and are tiered to first remove coins from the gripped wrappers and then remove the wrapper from the element. All necessary movement is accomplished through a single linkage coupling one stripper member with one of elements for simultaneous movement.

17 Claims, 4 Drawing Sheets

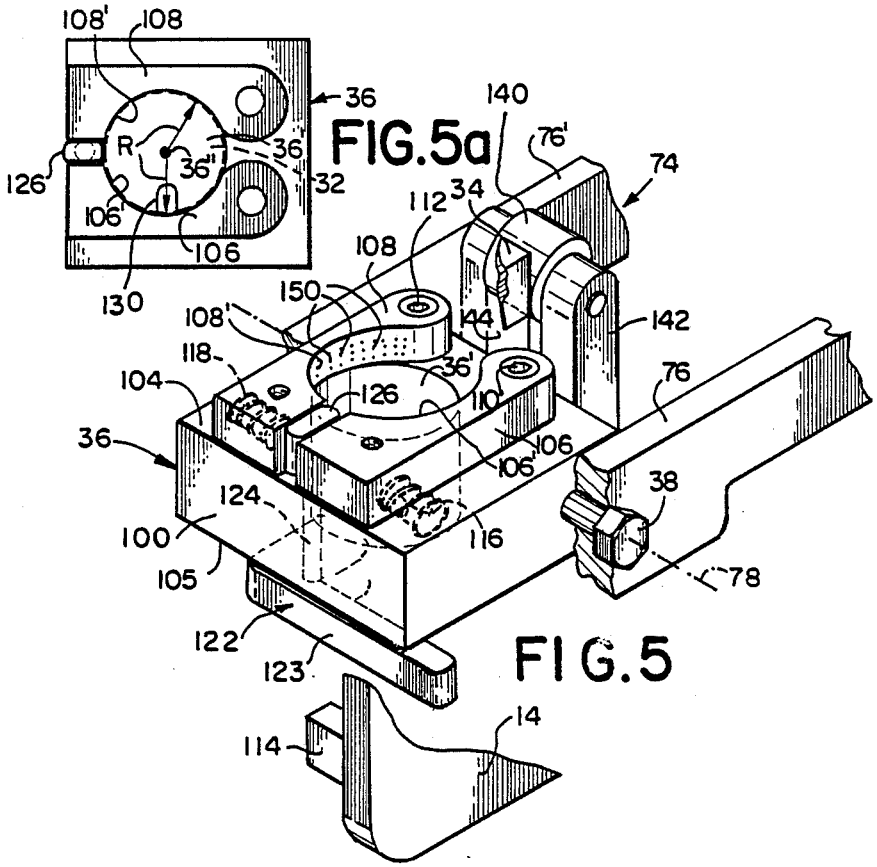
FIG.5a
FIG.5
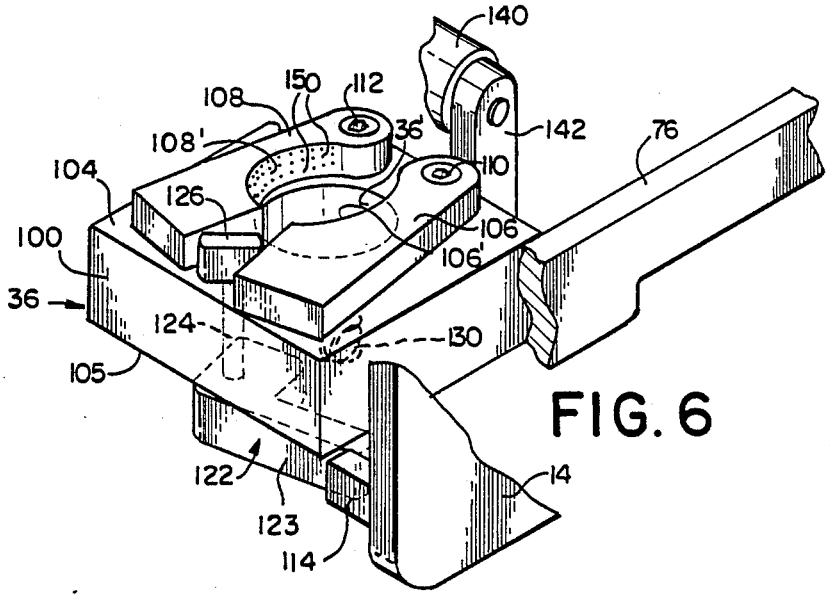
FIG. 6

DEVICE FOR BREAKING AND STRIPPING COINS FROM A COIN ROLL

FIELD OF THE INVENTION

The invention relates to the opening of an elongated cylindrical roll of wrapped coins ("coin roll") and the separation of the coins from the wrapper of the coin roll.

BACKGROUND OF THE INVENTION

With few exceptions, the majority of known coin roll wrapper removal devices are designed merely to cut a coin roll transversely to the central longitudinal axis of the roll at one or more points. Transverse cutting appears to be preferred as a means of preserving and prolonging the cutting surface(s) of the devices. Alternatively, some devices are designed to cut radially through an end portion of the wrapper overlapping a coin at the end of the roll. At best, all of these devices do no more than assist an individual in initially breaking the coin roll wrapper. The individual must still separate the coins from the wrapper by hand. This can be dirty and tiring work where large numbers of coin wrappers might be handled, such as in a bank, game arcade or casino.

SUMMARY OF THE INVENTION

Briefly stated, the invention is a device for breaking and removing coins from a coin roll where breaking is performed by mechanically shearing the roll as opposed to merely cutting the wrapper. In its most basic form, the invention comprises a pair of elements, each element having a channel adapted for receiving a portion of a coin roll and support means adapted for supporting the pair of elements in a first orientation adjoining one another with the channels of the two elements substantially coaxially aligned to simultaneously receive a coin roll, in a second orientation with the channels of the pair of elements laterally displaced with respect to one another, and during a translational movement of at least one of the pair of elements in the first orientation to laterally displace at least one of the aligned channels from the other to provide the second orientation whereby the coin roll simultaneously received in the aligned channels of the pair of elements in the first orientation is broken during the translational movement when the channels of the pair of elements are laterally displaced with respect to one another.

BRIEF DESCRIPTION OF THE DRAWINGS

The foregoing summary, as well as the following detailed description, will be better understood when read in conjunction with the appended drawings. For the purposes of illustrating the invention, there is shown in the drawings diagrammatic views of a preferred embodiment. It is understood, however, that this invention is not limited to the precise arrangement and instrumentality shown. In the drawings:

FIG. 5 is a perspective view of one of the pair of elements of the preferred embodiment used for breaking coin rolls, the element including a pair of reciprocable arms in a closed position for gripping a coin roll received in the element;

FIG. 5*a* is a local plan view of the element of FIG. 5;

FIG. 6 is a perspective, partially sectioned view of the element of FIGS. 5 and 5*a* with the pair of reciprocable arms opened to receive a coin roll; and FIGS. *7a–7d* are partially sectioned, side elevation views of the preferred embodiment along the lines 4—4 of FIG. 3 depicting very diagrammatically the operation of its major components.

DETAILED DESCRIPTION OF THE PREFERRED EMBODIMENT

Figure 1:
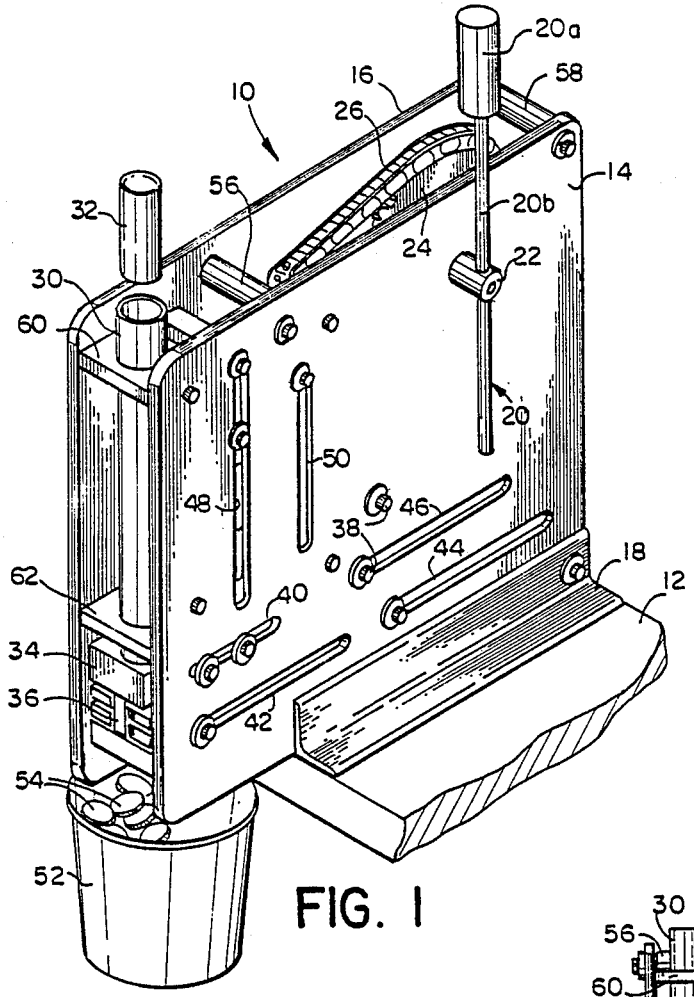
FIG. 1 is a perspective view of a preferred embodiment of the invention.
Figure 3:
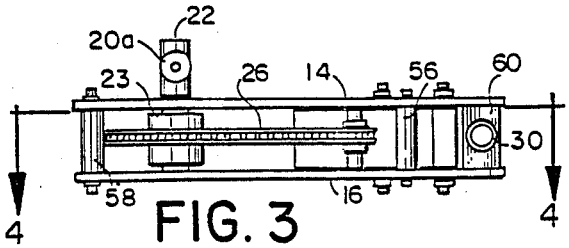
FIG. 3 is a local plan view of the preferred embodiment.
Figure 2:
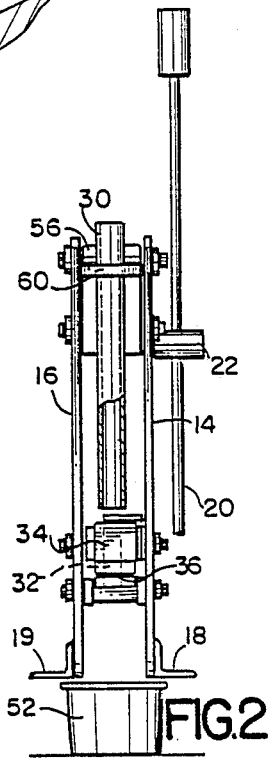
FIG. 2 is a partially sectioned front elevation of the preferred embodiment.

FIGS. 1–3 depict three exterior views of a preferred embodiment of the inventive device, indicated generally at 10, for breaking and removing coins from a coin roll. The device 10 is mounted to a horizontal support surface 12 (FIG. 1 only) for operation. Major features of the device 10 visible in FIGS. 1–3 include a pair of side plates 14 and 16, which are substantially symmetric to one another and support the remaining components of the invention, and a pair of right angle members 18 and 19 (FIG. 2 only) attached to the bottom of each of the side plates 14 and 16 respectively, to mount the device 10 to the support surface 12. A lever 20 includes a handle 20*a* at one end of an arm 20*b* which extends transversely through a shaft 22 supported for rotation in bearings (not depicted) journaled in the side plates 14 and 16. If desired, a counterweight (not depicted) can be provided at the lower end of arm 20*b* to assist in returning the lever 20 to the vertical position. As is best illustrated in FIG. 3, the shaft 22 is fixedly coupled with a collar 23 positioned between side plates 14, 16. The collar 23 is fixedly coupled with a main sprocket 24 seen in FIG. 1. The lever 20, shaft 22, collar 23 and main sprocket 24, constitute actuator means of the device, and drives a linkage means coupling certain components of the device for simultaneous movement. In the preferred embodiment the linkage means comprises an endless chain 26, a portion of which is visible in FIGS. 1 and 3, which extends around at least a portion of the main sprocket 24. A hollow, elongated tube 30 is vertically supported between the side plates 14 and 16 at the "front" end of the device 10 for receiving a coin roll 32 of wrapped coins and directing the coin roll 32 to a pair of elements 34 and 36 which are positioned beneath the lower end of the tube 30 and are used to break the coin roll. Element 34 is movably supported from side plates 14 and 16 by four of the bolts 38, two extending through horizontal slot 40 in side plate 14 and two extending through an aligned horizontal slot (40' in FIGS. 4 and *7a–7d*) in side plate 16 into the element 34. Element 36 is movably supported from side plates 14 and 16 by six of the bolts 38, each bolt passing through one of the horizontal, parallel slots 42, 44 and 46 in side plate 14 and an aligned set of slots (42', 44' and 46' in FIGS. 4 and *7a* through *7d*) in side plate 16 into a support member 74 (in FIGS. 4 and *7a* through *7d*). The bolts extending through slots 42 and 42' further extend into element 36 (see FIGS. 5 and 6) for rotational and translational support of the element 36 from the support member 74. Six additional bolts 38, three extending through a pair of vertical slots 48 and 50 in side plate 14 and three extending through an aligned set of slots (48' and 50' in FIGS. 4 and *7a* through *7d*) in side plate 16 into a support member 70 (see FIGS. 4 and 7*a* through 7*d*) are provided to movably support the support member 70 and a tiered stripper means (72 in FIGS. 4 and 7*a* through 7*d*) coupled with the support member 70. A receptacle such as a cup 52 can be used to receive coins 54 removed from the coin roll 32. If desired, a permanent receptacle (not shown) can be provided. Tubular spacers 56 and 58 assist in securing and aligning the side plates 14 and 16. Spacer blocks 60 and 62 provide a similar function as well as receiving and supporting the tube 30.

Figure 4:
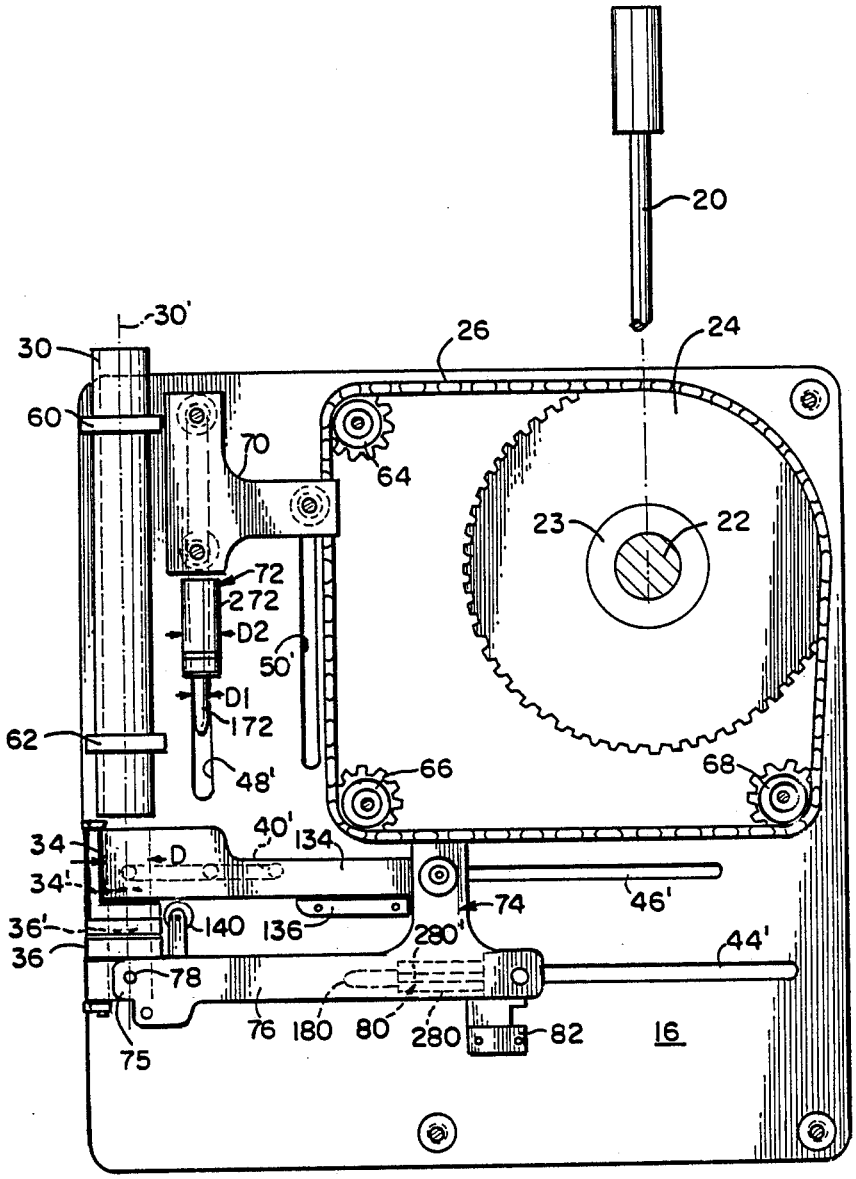
FIG. 4 is a partially sectioned side elevation of the preferred embodiment along the lines 4—4 of FIG. 3.

FIG. 4 is a side elevation of the device 10 with side plate 14 removed. Each of the pair members 34 and 36 is hollow and includes a channel 34′ and 36′, respectively, substantially cylindrical and vertically extending for receiving a portion of a coin roll 32 inserted into the supply tube 30. Each channel 34′ and 36′ has a minimum diameter, D, slightly larger than the diameter of the coin roll 32 which the elements 34 and 36 receive.

The upper element 34 and the pair of support members 70 and 74 are movably supported between the side plates 14 and 16 in the manner previously described from side plates 14 and 16. The first support member 70 and the second support member 74 are each coupled with the endless chain 26 of the linkage means for simultaneous vertical and horizontal movement, respectively. Additional sprockets 64, 66 and 68 are rotatably supported between side plates 14 and 16 and form part of the linkage means. The sprockets direct portions of the chain 26 vertically for movement of support member 70 and coupled, tiered stripper means 72 and horizontally for horizontal movement of support member 74 and coupled lower element 36. The lower element of 36 is supported between arms 76 and 76′ (see FIG. 5) of a yoke 75 of the lower support member 74 by the bolts 38 extending through slots 42 and 42′ and through the arms 76 and 76′ into the sides of the element 36. The lower element 36 is free to rotate about a central axis 78 passing through the center of those bolts 38. Another support member 82 is fixedly bolted between the side plates 14 and 16 and supports a second, tiered stripper means 80 between the arms 76 and 76′ of the second support member 74.

The first tiered stripper means 72 is elongated and includes an end portion 172, which is elongated and has a maximum diameter D1, and a second portion 272 adjoining the end portion 172 which is also elongated and has a maximum diameter D2 greater than the end portion maximum diameter D1 and no greater than the minimum diameter D of the channel 34′ of the upper element 34 for passing through the channel 34′ of that one upper element 34 and removing coins from a portion of a wrapper in the channel 34′ and then removing the portion of the wrapper from the channel 34′.

The second tiered stripper means 80 is configured similarly to the first stripper means 72 and includes an end portion 180 and a second portion 280 adjoining the end portion 180. The second portion 280 also has a maximum diameter (D2) greater than the maximum diameter (D1) of the end portion 180, but still less than the minimum diameter D of channel 36′ of the lower element 36. The second stripper means 80 further includes a channel 280′ running axially along the length of the second portion 280 to permit that portion to pass over a stop (130 in FIG. 5*a*) provided at the bottom of channel 36′ of the lower element 36.

Upper element 34 is supported for free translational movement along horizontal slots 40 and 40′ by the pairs of bolts 38 passing through each of those slots 40, 40′ into sides of the element 34. An "inward" extending arm 134 of the element 34 supports a strike plate 136 on its lower surface. Lower element 36 is supported for rotational movement about axis 78 normal to the plane of FIG. 4 by support member 74 and bolts 38 through slots 42, 42′ into element 36 and for horizontal translational movement with member 74. Because the slots 42, 42′, 44, 44′, 46, and 46′ supporting member 74 are longer than slots 40, 40′ supporting element 34, element 36 is further supported by member 74 for relative translational movement with respect to element 34 for laterally displacing the elements 34 and 36 with respect to one another. A roller 140 on element 36 cooperates with strike plate 136 to rotate element 36 in a manner to be described.

In FIG. 4, the elements 34 and 36 are supported in a first orientation adjoining one another with the channels 34′ and 36′ of the two elements adjoining and substantially coaxially aligned with one another. In this first orientation, channels 34′ and 36′ are also geneally coaxial along a common central axis 30′, which is also the central axis of the coin roll receiving tube 30, for receiving a coin roll inserted into the tube 30. Channel 34′ extends entirely through element 34 and has a minimum diameter D slightly larger than the predetermined diameter of a coin roll 32. Channel 36′ of the lower element 36 also has a minimum diameter D to receive a lower portion of such a coin roll. Element 36 includes a stop 130 (see FIG. 5*a*) at the lower end of channel 36′ to prevent movement of a coin roll 32 entirely through the element 36. The elements 34 and 36 are further sized and positioned for each simultaneously receiving at least about one-third and preferably about one-half of the axial height of a coin roll 32.

The lower element 36 is depicted in greater detail in FIGS. 5, 5*a* and 6. The element 36 includes a main block 100. The block 100 is rotatably supported between arms 76 and 76′ of the support member 74 as previously indicated by bolts 38 (only one bolt visible) extending through slots 42 and 42′ and arms 76 and 76′ into opposite sides of block 100.

Mounted on the upper surface 104 of block 100 are gripper means for gripping a coin roll received in channel 36′. The gripper means comprises a pair of reciprocable arms 106 and 108, each pivotally mounted for rotation on each of two opposing radial sides of the channel 36′ of element 36. Pivotal mounting of each arm 106, 108 is provided by a screw 110 and 112 through an end of each arm 106 and 108 respectively, into the block 100. The gripper means further comprises suitable means such as coil springs 116 and 118 (in phantom) mounted in block 100 for biasing together the free or distal ends of the reciprocable arms 106 and 108. The gripper means further comprises means for camming the free ends of the arms 106 and 108 apart. The means include a generally L-shaped lever 122 coupled by means of a shaft 124 passing vertically through the block 100 to a cam member 126 positioned between the free end of each of the reciprocable arms 106 and 108. As is depicted in FIG. 6, the lever 122 is rotated when arm 123 contacts a camming surface 114 on an inner side of side plate 14 when the lower element 36 is in its "forwardmost" possible position, (i.e. the first orientation shown in FIG. 4), in which channel 36′ is coaxially aligned with the central axis 30′. In this position, the cam 126 forces the reciprocable arms 106 and 108 apart to permit the element 36 to receive a coin roll 32 in its channel 36′. In the "closed" position indicated in FIGS.

5 and 5*a* the arms 106 and 108 positively grab and hold a coin roll 32 (in phantom in FIG. 5*a*) received in the channel 36'.

A roller 140 is supported between a pair of vertical arms 142 and 144 mounted to an inner vertical side surface of the block 100. The roller 140 is used to rotate the element 36 as well as to reposition the upper element 34, in a manner to be described with respect to FIGS. 7*a* through 7*d*.

Though not depicted in detail, the upper element 34 is similar in construction to the lower element 36 in that it also includes gripper means comprising a pair of reciprocable arms rotatably mounted at one end to a lower surface of that element, facing and adjoining the arms 106 and 108 of the lower element 36. The reciprocable arms of the upper element 34 are similarly cammed between open and closed positions in the manner described for the operation of the reciprocable arms 106 and 108 of element 36.

A substantially cylindrical curved gripping surface 108' with a substantially uniform radius of curvature is provided on arm 108. A symmetric, curved gripping surface 106' is provided on a side of the arm 106 facing arm 108. The radius of curvature of each of the gripping surfaces 106' and 108' is sized very closely to but slightly larger than the radius of the largest coin rolls 32 to be received in the channels 34' and 36', appreciating that slight differences in radii will exist among different types of coin roll wrappers (e.g. paper and plastic), even for the same coin denominations. For the depicted embodiment 10, a different set of arms 106 and 108 should be provided and, preferably, a different block 100 (and comparable block and arms for element 34) provided for coin rolls of different denominations (e.g. dimes, quarters, half dollars, etc.). Also, as is indicated in FIG. 5*a*, the arms 106 and 108 are positioned such that the curved gripping surfaces 106' and 108' of each arm share a common radius of curvature R centered at the central axis 36' of the channel 36' and a central axis through a coin roll 32 (in phantom) received in channel 36'.

Centerpoints 150 are provided by punching on surface 108' and on unseen surface 106' (and on like surfaces of the reciprocable arms provided on the element 34) to assist in holding a broken portion of a coin roll in the channel. The centerpoints 150 are not required.

Figure 7A:
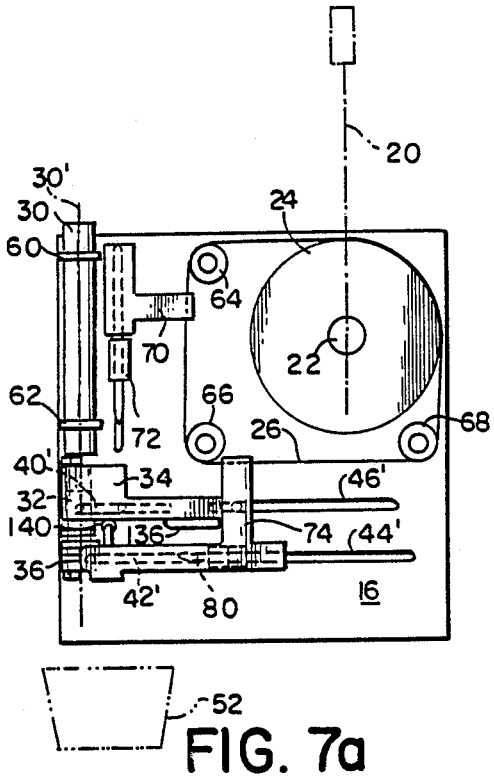

Operation of the device 10 is depicted in sequential steps in FIGS. 7*a* through 7*d*. FIG. 7*a* shows the apparatus in its first orientation for receiving a coin roll. The pair of elements 34 and 36 are in their forwardmost (leftmost in FIGS. 7*a* through 7*d*) position of travel, adjoining one another with their channels 34' and 36' substantially coaxially aligned with one another and with the central axis 30' of the feed tube 30. Cam surfaces such as cam surface 114, on one or the other of the side walls 14 and 16 maintain the reciprocable arms 106 and 108 of element 36 and like arms of element 34 in the open position to allow free passage of a coin roll through the tube 30 and channels 34' and 36', to the stop 130 located at the bottom of element 36.

Figure 7B:
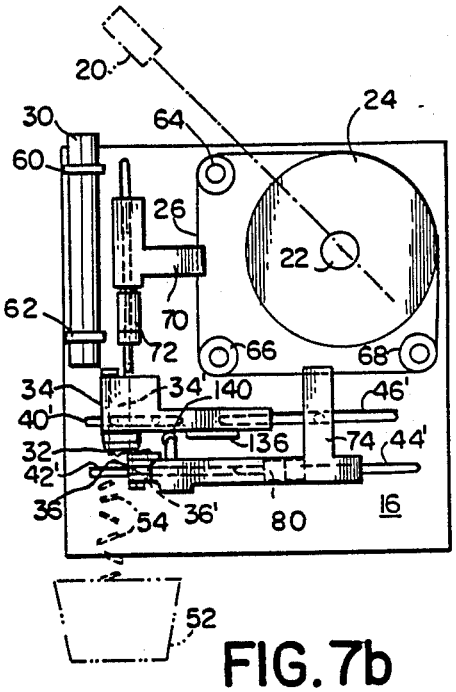

FIG. 7*b* shows initial counterclockwise rotation of the lever and subsequent motion of the components to a second orientation with the elements 34 and 36 transversely displaced, in particular laterally displaced, with respect to one another and with their channels 34' and 36' laterally displaced so they are no longer coaxially aligned. As the lever 20 is rotated in a counterclockwise direction, endless chain 26 pulls second support member 74 horizontally to the right along the parallel slots 42, 42', 44, 44', 46 and 46'. Element 36 is drawn inward (rightward in figure) by support member 74 and endless chain 26. The unbroken coin roll 32 couples the elements 34 and 36 together, thereby causing the upper element 34 to be pulled along the parallel horizontal slots 40 and 40' by the lower element 36. The simultaneous horizontal translational movement of the elements 34 and 36 continues until the upper member 34 reaches its innermost position of travel (rightmost in FIGS. 7*a* through 7*d*) at the end of slots 40 and 40'. At that point, the second support member 74 with lower element 36 continues to be drawn inward by the chain 26 through continued counterclockwise rotation of the lever arm 20 thereby laterally displacing element 36 from element 34. The coin roll 32, simultaneously received in the channels of the two elements 34 and 36 in the first orientation in FIG. 7*a*, is broken when the pair of elements 34 and 36 are laterally displaced from one another by the continued horizontal translational movement of lower element 36 to the second orientation. In particular, the coin roll 32 is sheared between the now stationary upper element 34 and the lower element 36 which continues to be transversely displaced in the horizontal direction from element 34. At the innermost point of travel of the upper element 34, the channel 34' is aligned coaxially with the tiered stripper means 72.

Figure 7C:
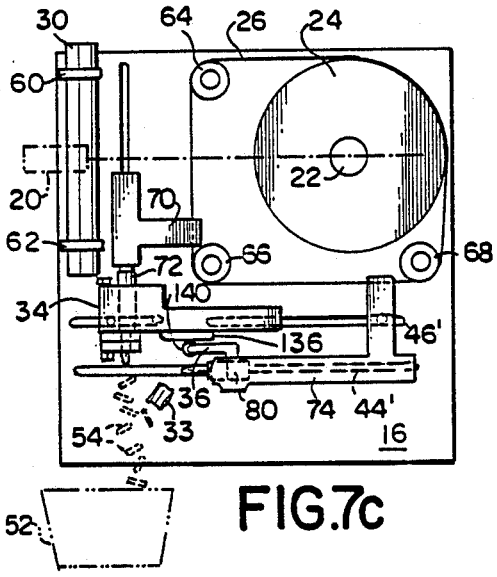

FIG. 7*c* depicts the components of the device 10 in a third configuration. The lever 20 has been rotated counterclockwise to the horizontal position and the support member 74 and lower element 36 have reached their innermost point of travel at the ends of the channels 42, 42', 44, 44', 46 and 46'. Before reaching that position, the lower element 36 has been rotated 90° degrees in a counterclockwise direction by its roller 140 striking the strike plate 136. The central axis of its channel 36' is horizontal and coaxial with the central axis of the second tiered stripper means 80. The tiered stripper means 72 is moved downwardly by support member 70 and chain 26 and pass through the channel 34' of the upper element 34. As the first tiered stripper means 72 is passing through the channel 34' of the upper element 34, the lower element 36 is drawn over the second tiered stripper means 80 passing that stripper means 80 through channel 36' thereby removing the broken coin roll from the channel of each element. In particular, the narrower end portions 172 and 180 of each of the tiered stripper means 72 and 80 are first to pass through the respective channels 34' and 36' removing from each channel and element any coins 52 from a broken portion of the coin roll wrapper 33 retained in the channel. The adjoining, thicker sections 272 and 280 of FIG. 4 of each of the tiered stripper means 72 and 80 thereafter pass through a channels 34' and 36' respectively, and reciprocable arms removing from the channels and reciprocable arms the portion 33 of the coin roll wrapper remaining in each of the channels 34' and 36'.

Figure 7D:
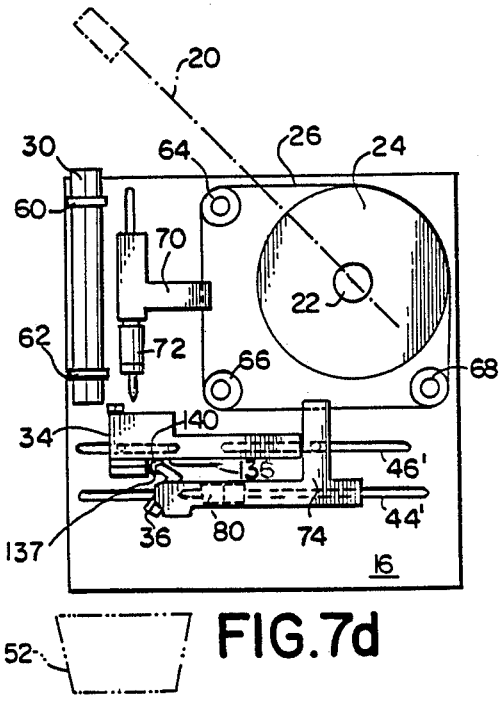

Referring now to FIG. 7*d*, as the lever 20 is raised (rotated clockwise) from the horizontal position in FIG. 7*c*, the upper support member 70 is raised withdrawing stripper means 72 from the channel 34' of the upper element 34. Support member 74 is drawn forward (leftward in the figure) withdrawing lower element 36 from the second stripper means 80. Continued forward (leftward in the figure) movement of the lower element 36 causes the roller 140 to travel off the strike plate 136 and contact a vertical surface 137 on the inner side of the upper element 34. As the lever 20 continues to be raised, the roller 140 causes the lower element 36 to rotate clockwise as indicated in FIG. 7*d* until the lower and upper faces of the upper and lower elements 34 and 36, respectively, are again adjoining with their channels 34' and 36' adjoining and substantially coaxial as shown in FIG. 7*a*. The upper element 34 may be pushed forward (leftward in FIG. 7*d*) during rotation of the lower element 36. However, when that element 36 has reached a fully rotated position, the continued raising of the lever 20 and forward (leftward) movement of the second support member 74 forces lower element 36 against the upper element 34 pushing the upper element 34 forward until the first orientation of the elements 34 and 36 depicted in FIG. 7*a* is again achieved.

While the preferred embodiment is disclosed and described in the figures, one of ordinary skill in the art will appreciate that numerous modifications are possible. For example, manual actuation through the lever 20 is disclosed as having a particular attraction to casinos where such machines might be provided with lever operated slot machines. However, any other type actuation means, particularly an electric motor or other prime mover conventionally used to rotate an element might be employed and might even be desirable or preferred for some applications. A linkage means comprising sprockets and an endless chain is disclosed for coupling the movement of the lower element 36 and first tiered stripper means 72 with one another and with the actuator means formed by the lever 20, its connected shaft 22 and main sprocket 23. It will be appreciated that other linkage means including a tensioned flexible wire and pulleys, a gear train, a bell crank, etc. might be employed to link the movable components of the device together and with an actuator means. Moreover, various components of the preferred device might be rearranged. For example, the operation of the elements 34 and 36 may be reversed with the upper element 34 rotating and causing the movement of the lower element 36. Alternatively, the lower element 36 may be releasably coupled to a transporting member like the support member 74 and merely transversely separated from the upper member 34 by translational movement but not thereafter rotated. Upon reaching the end of its travel, the lower member 36 would "break-away" from the transporting member 74, so that a pair of stripper means like stripper means 72 or 80 can be passed through the channels of the transversely separated elements 34 and 36 by continued movement of the actuator means and linkage means. Reversal of the operation would cause the lower element to recouple with the transport member.

It will recognized by those skilled in the art that other changes may be made to the above-described invention and to the modifications to that invention suggested above, without departing from the broad inventive concepts thereof. It is understood therefore, that this invention is not limited to the particular embodiments described or disclosed, but it is intended to cover any modifications which are in the scope and spirit of the invention as defined by the appended claims.

We claim:

1. A device for breaking a coin roll comprising:

a pair of elements, each element having a channel adapted for receiving a portion of a coin roll;

support means adapted for supporting the pair of elements in a first orientation adjoining one another with the channels of the two elements substantially coaxially aligned to simultaneously receive a coin roll and in a second orientation with the channels of the pair of elements laterally displaced with respect to one another and during a translational movement of at least one of the pair of elements in the first orientation to laterally displace at least one of the aligned channels from the other to provide the second orientation whereby the coin roll simultaneously received in the aligned channels of the pair of elements in the first orientation is broken during the translational movement when the channels of the pair of elements are laterally displaced with respect to one another; and stripper means for passing through the channel of a first one of the pair of elements.

2. The device of claim 1 wherein said stripper means is tiered and includes an end portion having a maximum diameter and a second portion adjoining the end portion having a maximum diameter greater than the end portion maximum diameter and no greater than a minimum diameter of the channel of one of the pair of elements for passing through the channel of the one element and removing coins from a portion of the coin roll wrapper in the channel and then removing the portion of the coin roll wrapper from the channel.

3. The device of claim 1 further comprising linkage means coupled with the stripper means and with the second one of the pair of elements for simultaneously moving the stripper means and the second one of the pair of elements.

4. The device of claim 3 wherein said linkage means is coupled with the second element through said support means.

5. The device of claim 1 wherein at least one of the pair of elements further comprises gripper means for gripping a coin roll received in the channel of the one element.

6. The device of claim 5 wherein said gripper means comprises a pair of reciprocable arms mounted on each of two opposing radial sides of the channel of the one element.

7. A device for breaking a coin roll comprising:

a first element having a channel adapted to receive a portion of the coin roll;

a second element having a channel adapted to receive another portion of the coin roll received by the first element;

gripper means on one of the first and second elements for gripping the coin roll received in the channel of the one element, said gripper means comprising a pair of reciprocable arms mounted on each of two opposing radial sides of the channel of said one element, and means for camming ends of the reciprocable arms apart; and support means adapted for supporting the pair of elements in a first orientation adjoining one another with the channels of the two elements substantially coaxially aligned to simultaneously receive a coin roll and in a second orientation with the channels of the pair of elements laterally displaced with respect to one another and during a translational movement of at least one of the pair of elements in the first orientation to laterally displace at least one of the aligned channels from the other to provide the second orientation whereby the coin roll simultaneously received in the aligned channels of the pair of elements in the first orientation is broken during the translational movement when the channels of the pair of elements are laterally displaced with respect to one another.

8. The device of claim 7 wherein each of the reciprocable arms has a curved gripping surface with a substantially uniform radius of curvature and is pivotally mounted on the one element so that the curved gripping surfaces of the two arms can be positioned to share a common radius of curvature centered at the center of the channel of the one element.

9. The device of claim 8 wherein said gripper means further comprises means for biasing ends of the reciprocable arms together.

10. The device of claim 7 wherein said gripper means further comprises means for biasing the ends of the reciprocable arms together.

11. The device of claim 10 wherein the first element is the one element having the gripper means and further comprising stripper means adapted for passing through the channel of the first element.

12. The device of claim 11 wherein stripper means is tiered having an end portion with a first maximum diameter and a second portion adjoining the end portion with a second maximum diameter greater than the first maximum diameter and no greater than a minimum diameter of the channel of the first element for passing through the channel of the first element.

13. The device of claim 12 further comprising linkage means coupled with said support means and with said stripper means for transversely separating the first and second elements and passing the stripper means through the channel of the first element.

14. A device for breaking a coin roll comprising:

a first element having a channel adapted for receiving a portion of an elongated roll of wrapped coins;

a second element having a channel adapted for receiving a portion of an elongated roll or wrapped coins;

support means coupled with the first and second elements for supporting the first and second elements in a first orientation with the first and second elements adjoining and the channels of the first and second elements substantially coaxially aligned and adjoining for simultaneously receiving a coin roll in the channels of the first and second elements and in a second orientation of the first and second elements with the channels non-coaxially positioned with respect to one another and during movement of the first and second elements between the first and second orientations; and stripper means supported by the support means and adapted for passing through the channel of the first element in the second orientation and removing a broken coin roll from the channel of the first element.

15. The device of claim 14 further comprising linkage means coupled with the second element and the stripper means for simultaneously moving the stripper means and the second element.

16. The device of claim 14 wherein said stripper means is tiered having an end portion with a first maximum diameter and an adjoining portion having a second maximum diameter greater than the first maximum diameter but no greater than a minimum diameter of the first element.

17. The device of claim 14 further comprising second stripper means coupled with the support means and adapted for passing through the channel of the second element.

* * * * *